US005261532A

United States Patent [19]

Fauci

[11] Patent Number: 5,261,532

[45] Date of Patent: Nov. 16, 1993

[54] REUSABLE PLASTIC BAG

[76] Inventor: Keith Fauci, 336 Golfview Rd. Apt. 1012, North Palm Beach, Fla. 33408

[21] Appl. No.: 997,163

[22] Filed: Dec. 28, 1992

[51] Int. Cl.[5] ..... B65D 77/00

[52] U.S. Cl. ..... 206/218; 206/217; 229/103.1; 383/38; 383/63; 383/100; 383/103

[58] Field of Search ..... 206/217, 218; 383/38, 383/40, 63, 100, 103; 229/103.1

[56] References Cited

U.S. PATENT DOCUMENTS

| | | | |
|---|---|---|---|
| 1,822,190 | 9/1931 | Ziele | 383/100 |
| 2,633,287 | 3/1953 | Jacobsson | 383/38 |
| 3,304,977 | 2/1967 | Hammons | 383/38 |
| 3,537,455 | 11/1970 | Skyles | 383/100 |
| 3,939,888 | 2/1976 | Scarnato | 206/218 |
| 4,772,278 | 9/1988 | Baber | 383/100 |
| 4,783,176 | 11/1988 | Ichikawa | 206/217 |
| 4,806,021 | 2/1989 | Koudstaal et al. | 206/217 |
| 4,943,168 | 7/1990 | Berg et al. | 383/38 |
| 4,961,495 | 10/1990 | Yoshida et al. | 383/38 |
| 5,054,631 | 10/1991 | Robbins, III | 229/103.1 |
| 5,059,036 | 10/1991 | Richison et al. | 383/103 |
| 5,113,599 | 5/1992 | Cohen et al. | 383/100 |
| 5,142,970 | 9/1992 | ErkenBrack | 383/100 |

FOREIGN PATENT DOCUMENTS

| | | | |
|---|---|---|---|
| 633784 | 12/1963 | Belgium | 383/100 |
| 3226002 | 1/1984 | Fed. Rep. of Germany | 206/217 |
| 2073703 | 10/1981 | United Kingdom | 383/100 |

*Primary Examiner*—David T. Fidei
*Attorney, Agent, or Firm*—Leon Gilden

[57] ABSTRACT

A bag structure includes an upper resealable zipper strip positioned adjacent a top wall portion of an upper edge of the bag, with the top wall portion fixedly containing a vent tube therewithin. The vent tube includes a central tube web in alignment with the top wall, and includes a central aperture therethrough mounting a valve member therewithin. The valve member is operative to release pressure from interiorly of the bag body and is biased to a closed position to maintain contents within the bag body in a sealed relationship.

3 Claims, 4 Drawing Sheets

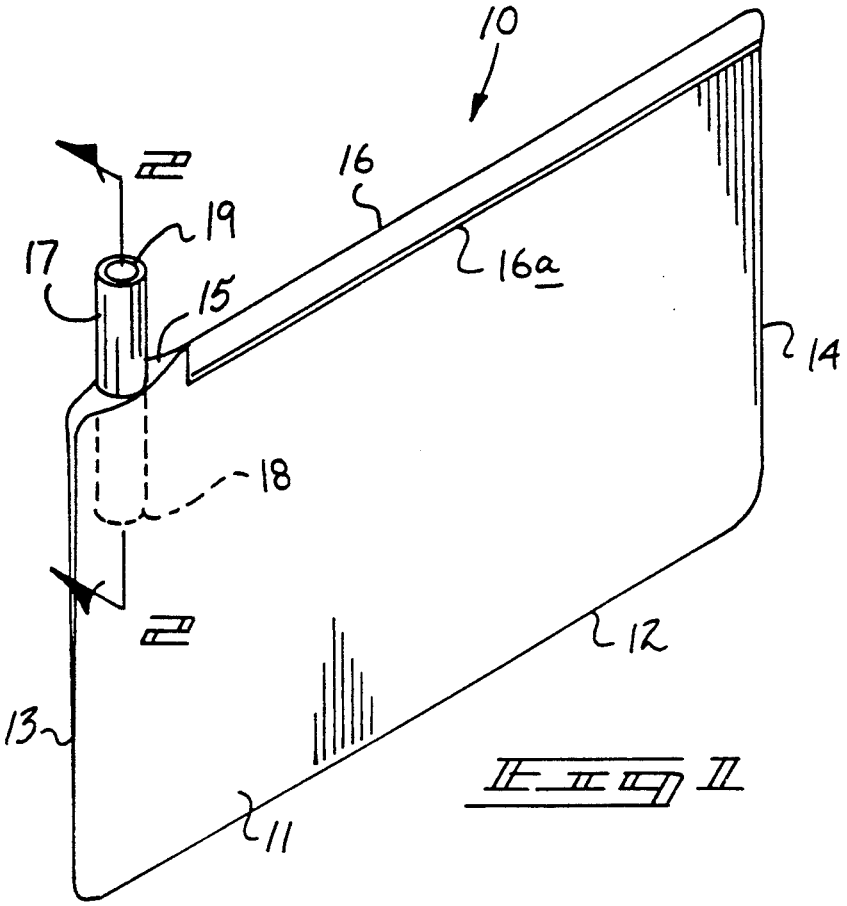
Fig 1
Fig 2
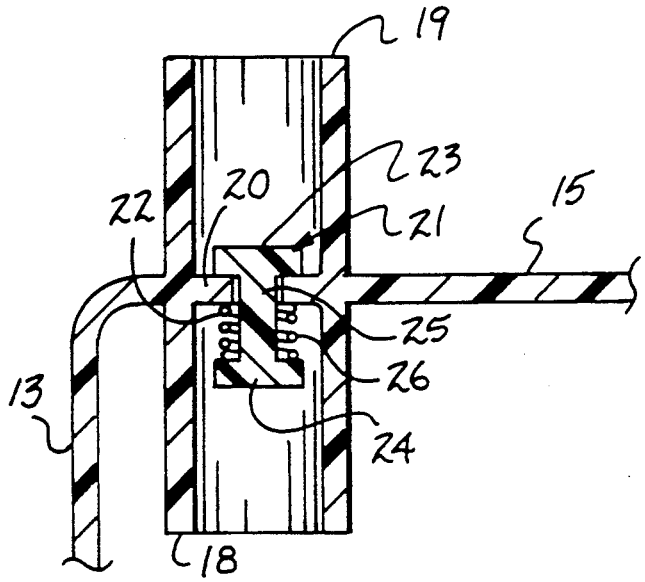

REUSABLE PLASTIC BAG

BACKGROUND OF THE INVENTION

1. Field of the Invention

The field of invention relates to plastic bag construction, and more particularly pertains to a new and improved reusable plastic bag permitting selective venting of air from within the bag body upon sealing the bag body and contents positioned therewithin.

2. Description of the Prior Art

Various sealing bags are provided in the prior art to provide selective sealing of a compartment within the bag structure. Such bag structure is exemplified in U.S. Pat. No. 4,703,518 to Ausnit wherein a plastic zipper structure is arranged for mounting exterior surfaces of the bag structure to effect sealing of the bag structure and closure thereof.

U.S. Pat. No. 4,736,496 to Fisher, et al. sets forth a closure for use in thermoplastic bags utilizing a member projected within a track to effect sealing and closure of an associated bag.

U.S. Pat. No. 4,691,373 to Ausnit sets forth a zipper closure for use with bag structure formed with a unitary adhesive cover sheet for mounting interiorly of a bag surface.

U.S. Pat. No. 4,691,372 to Van Erden sets forth a method of making reusable bag structure.

U.S. Pat. No. 4,658,433 to Savicki sets forth a further example of a closure bag utilized by the prior art.

As such, it may be appreciated that there continues to be a need for a new and improved reusable plastic bag as set forth by the instant invention which addresses both the problems of ease of use as well as effectiveness in construction in permitting venting of an interior chamber of the bag and in this respect, the present invention substantially fulfills this need.

SUMMARY OF THE INVENTION

In view of the foregoing disadvantages inherent in the known types of plastic bag construction now present in the prior art, the present invention provides a reusable plastic bag wherein the same utilizes a vent tube mounted through a top wall of the plastic bag to permit venting of entrapped air within the bag structure subsequent to sealing thereof. As such, the general purpose of the present invention, which will be described subsequently in greater detail, is to provide a new and improved reusable plastic bag which has all the advantages of the prior art plastic bag construction and none of the disadvantages.

To attain this, the present invention provides a bag structure including an upper resealable zipper strip positioned adjacent a top wall portion of an upper edge of the bag, with the top wall portion fixedly containing a vent tube therewithin. The vent tube includes a central tube web in alignment with the top wall, and includes a central aperture therethrough mounting a valve member therewithin. The valve member is operative to release pressure from interiorly of the bag body and is biased to a closed position to maintain contents within the bag body in a sealed relationship.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved reusable plastic bag which has all the advantages of the prior art plastic bag construction and none of the disadvantages.

It is another object of the present invention to provide a new and improved reusable plastic bag which may be easily and efficiently manufactured and marketed.

It is a further object of the present invention to provide a new and improved reusable plastic bag which is of a durable and reliable construction.

An even further object of the present invention is to provide a new and improved reusable plastic bag which is susceptible of a low cost of manufacture with regard to both materials and labor, and which accordingly is then susceptible of low prices of sale to the consuming public, thereby making such reusable plastic bag economically available to the buying public.

Still yet another object of the present invention is to provide a new and improved reusable plastic bag which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the instant invention.

FIG. 2 is an orthographic view, taken along the lines 2—2 of FIG. 1 in the direction indicated by the arrows.

DESCRIPTION OF THE PREFERRED EMBODIMENT

Figure 3:
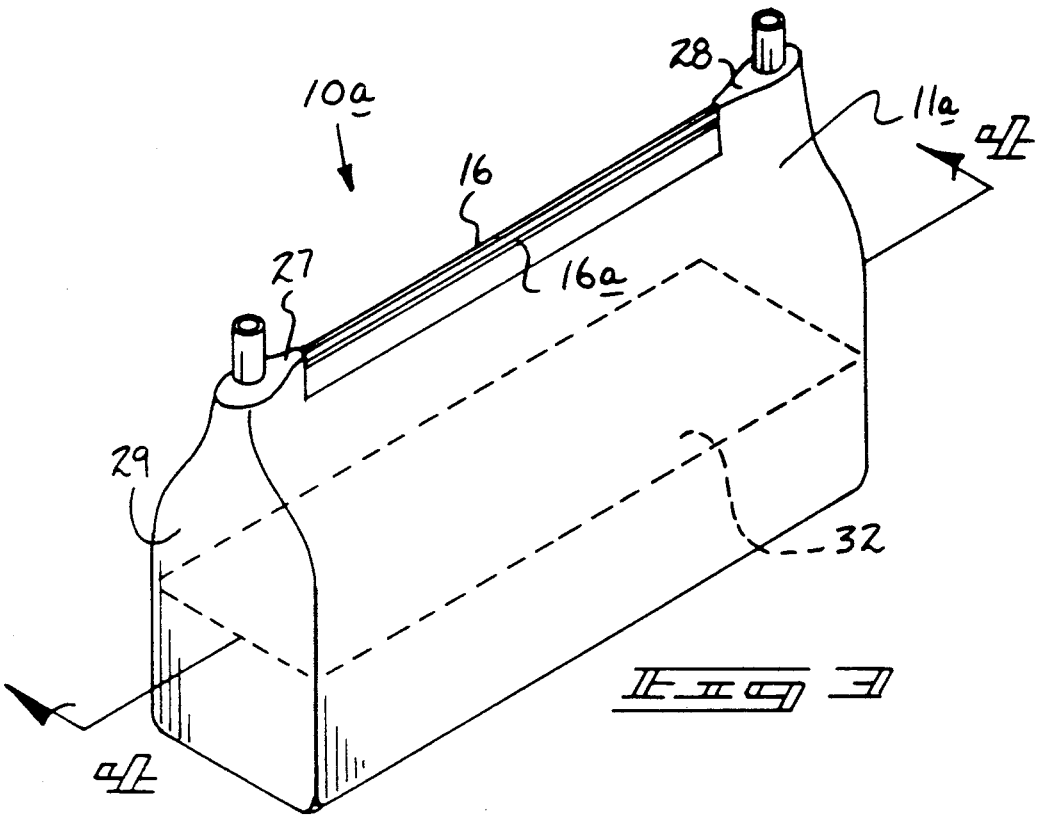
FIG. 3 is an isometric illustration of a modification of the instant invention.

With reference now to the drawings, and in particular to FIGS. 1 to 7 thereof, a new and improved reusable plastic bag embodying the principles and concepts of the present invention and generally designated by the reference numerals 10, 10*a*, and 10*b* will be described.

More specifically, the reusable plastic bag 10 of the instant invention essentially comprises a bag member body 11 formed of polymeric fluid impermeable sheet members secured together to define a lower bag edge 12, with a first side edge 13 spaced from a second side edge 14. The top of the bag construction includes a top edge first portion 15 defining a top wall surface coextensive with a top edge second portion 16, including cooperative portions of the bag sides to define a zipper strip 16*a* in a like manner, as set forth in U.S. Pat. No. 4,736,496 incorporated herein by reference.

A vent tube member 17 is fixedly mounted and projects through the top wall surface of the first portion 15. The tube member 17 includes a tube lower terminal end 18 positioned within the bag member body 11, with a tube upper terminal end 19 positioned above the top wall surface, as illustrated. A central tube web 20 extends interiorly of the tube 17 between the upper and lower terminal ends and includes a valve member 21 reciprocatably mounted through the tube web 20 through a web opening 22 directed through the tube web 20. The valve member 21 includes the top flange 23 spaced from a bottom flange 24, including a central shaft 25 slidably received within the web opening 22. A spring member 26 is captured between a bottom surface of a central tube web 20 and an upper surface of the bottom flange 24 to maintain the valve member 21 in a closed configuration, as illustrated in FIG. 2, whereupon compression of the bag member 11 subsequent to its sealing utilizing the zipper strip 16*a*, entrapped air is expelled through the web opening 22 upon displacement of the top flange 23 relative to the tube web 20.

Figure 4A:
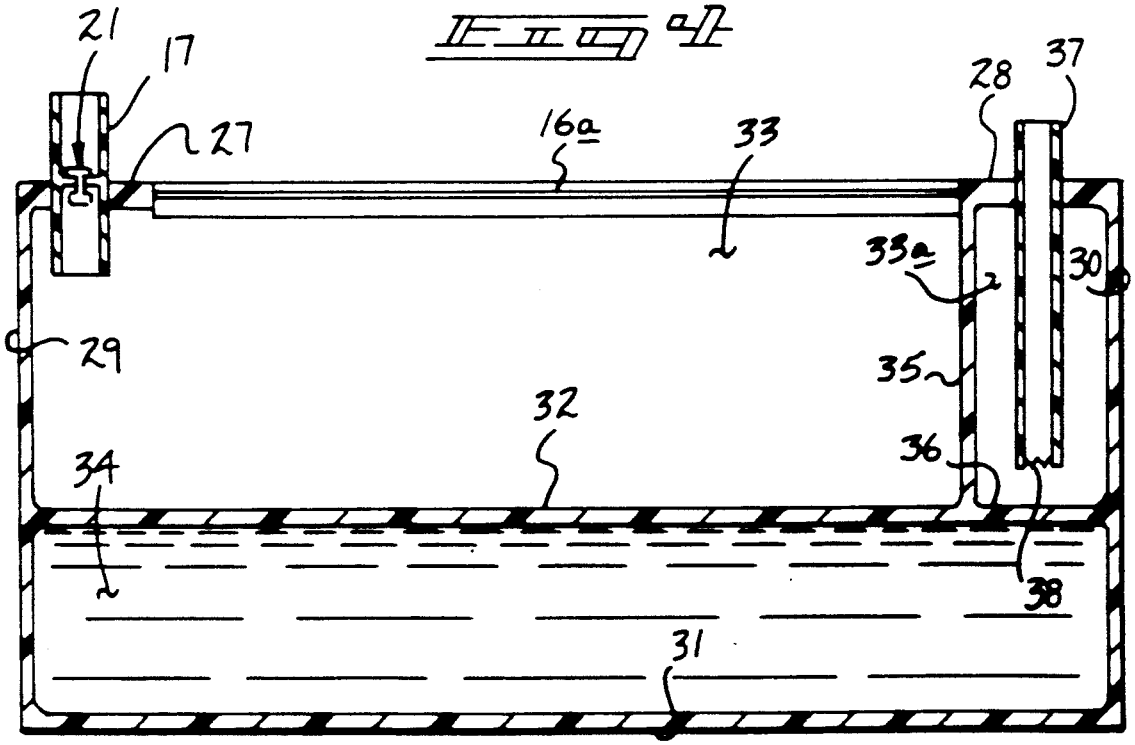
FIG. 4 is an orthographic view, taken along the lines 4—4 of FIG. 3 in the direction indicated by the arrows.

FIGS. 3 and 4 illustrate a modified bag construction 10*a*, wherein the bag member body is defined by a modified body construction 11*a*, including first and second top wall surfaces 27 and 28 positioned upon opposed ends of the zipper strip 16*a*. First and second respective end walls 29 and 30 are mounted to the bottom wall 31 of the modified bag 11*a*, with the side walls of the bag extending upwardly to the zipper strip to define the enclosure of the bag construction 10*a*. In addition to the vent tube member 17 directed through the first top wall surface 27, a rigid drinking straw 37 is slidably received through the second top wall surface 28. The bag construction includes a central flexible bag web 32 extending interiorly of the bag between the end walls and side walls spaced above the bottom wall 31. A partition wall 35 extends from the second top wall surface 28 downwardly to the central flexible bag web 32 and coextensively within the bag interior to define a third chamber 33*a* spaced from the first chamber 33, with a second chamber 34 defined between the flexible bag web 32 and the bottom wall 31. The rigid drinking straw 37 is slidably contained within the second top wall surface 28 and includes a serrated lower straw end 38 arranged for rupturing a rupturable web portion 36 positioned under the serrated lower end 38 within the third chamber 33, with the rupturable web portion 36 substantially coextensively with the central flexible bag web 32. In this manner, an emergency ration of an adjustable fluid is contained within the second chamber 34 for use in emergency situations and is useful for backpackers, survivalists, and the like for providing a bag with an emergency drinking portion and permits resealing of the first chamber 33 but always provides for a safety margin of food content within the second chamber, as illustrated.

Figure 5:
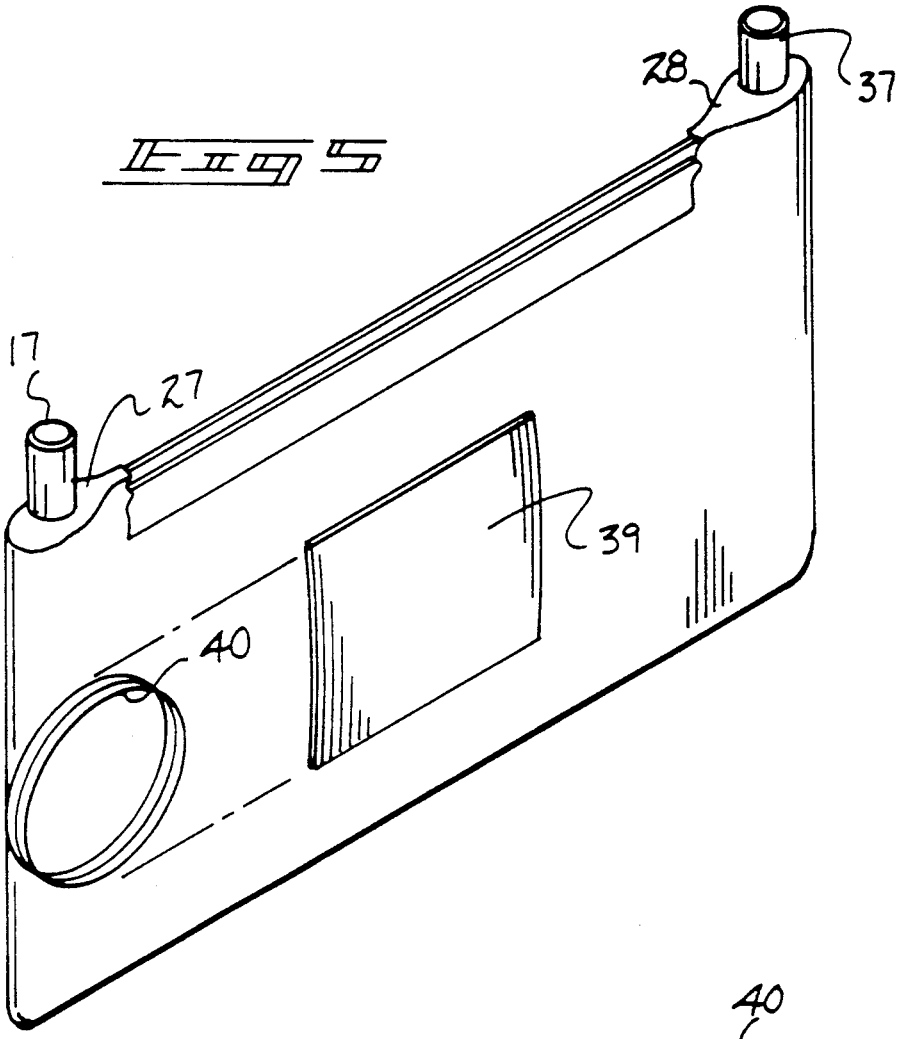
FIG. 5 is an isometric illustration of a further modified bag structure utilized by the instant invention.
Figure 6:
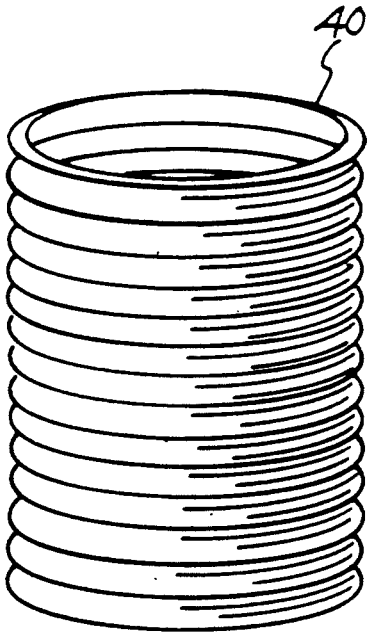
FIG. 6 is an isometric illustration of a collapsible cup utilized by the bag construction of the instant invention.

The construction of the bag of FIG. 5 includes a pouch member 39 mounted to a side wall of the bag, including a collapsible cup member 40 contained therewithin, wherein the cup member includes an accordion pleated wall 40 that is collapsed and received within the bag to permit an individual to share contents of the first chamber 33 with others.

Figure 7:
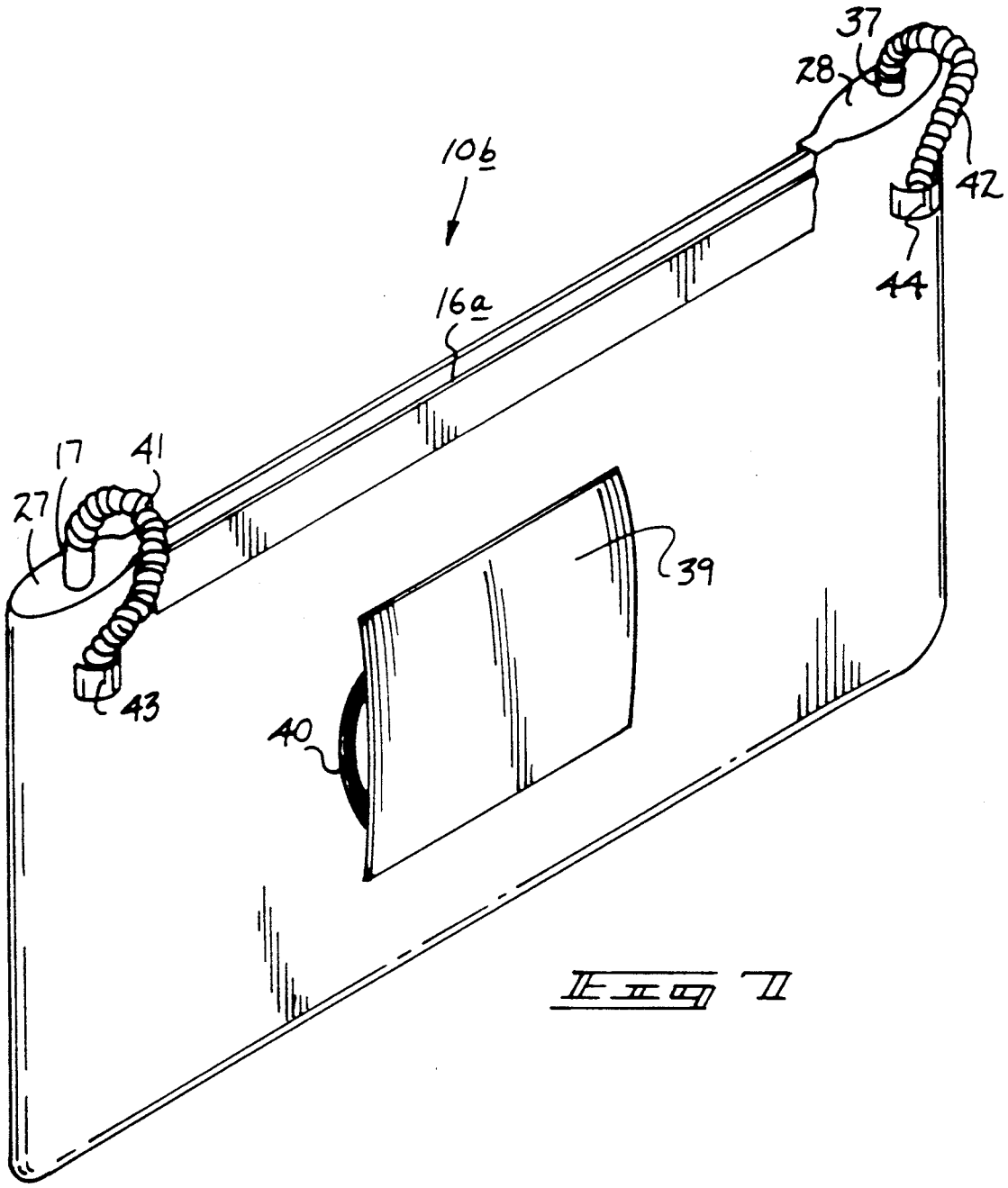
FIG. 7 is an isometric illustration of a yet further modified bag construction of the instant invention.

The bag construction 10*b*, as set forth in FIG. 7, further includes a respective first and second flexible tube section 41 and 42 mounted to upper terminal ends of the vent member 17 and the drinking straw 37. Each upper terminal end of flexible tube section is received within a respective first and second pocket 43 and 44 to maintain such end portions relatively free of contamination prior to use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous, modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A reusable plastic bag, comprising, a flexible fluid impermeable bag member body, the bag member body including first and second sides, and a bottom portion, and a top portion including a top edge first portion and a top edge second portion, the top edge first portion defines a top wall surface, and the top edges second portion includes a plurality of cooperating edges, said edges include a zipper means for selective securement of the edges together, and a vent tube member directed through the top edge first portion fixedly mounted therethrough, wherein the vent tube member includes a lower terminal end positioned within the bag member body, and an upper terminal end spaced above the bag member body, and the vent tube member includes a central tube web diametrically directed within the central tube web including a web opening, and a valve member reciprocatably mounted within the valve opening, and the valve member including biasing means to bias the valve member in a first closed position, whereupon compression of the bag member body effects displacement of the bag member to a second raised position relative to the central tube web, and the valve member includes a valve top flange positioned above the central tube web, and a valve bottom flange positioned below the central tube web, and a valve central shaft fixedly mounted between the top flange and the bottom flange reciprocatably mounted through the web opening, and a spring member captured between a bottom surface of the central tube web and a top surface of the valve bottom flange, and a further top wall surface, the further top wall surface positioned adjacent the zipper strip spaced from the first portion, and a central flexible bag web mounted coextensively within the bag between the first and second sides spaced above the bottom portion defining a first chamber spaced above the central flexible bag web and a second chamber positioned below the central flexible bag web between the central flexible bag web and the bottom portion, and a flexible partition wall projecting coextensively within the bag from the further top wall surface downwardly into communication with the central bag web, and a drinking straw member slidably projecting through the further top wall surface, and the drinking straw including a serrated cutting edge formed at a lower terminal end of the drinking straw, and the central flexible bag web positioned under the drinking straw is rupturable when the drinking straw is projected through the central bag web.

2. A bag as set forth in claim 1 including a pouch member mounted to a side wall of the bag member body, and the pouch including a collapsible cup member mounted therewithin, the cup member including an accordion pleated wall permitting collapsing of the cup member and storage within the pouch.

3. A bag as set forth in claim 2 wherein the vent tube member upper terminal end includes a first flexible tube section mounted coextensively therewith, and the first flexible tube section including a first free end, and a first pocket mounted on an exterior surface of the bag member body receiving the first free end therewithin, and the drinking straw including a second flexible tube section mounted coextensively therewithin, and the second flexible tube section including a second free end, and the second pocket mounted to an exterior surface of the bag member body, and the second free end selectively received within the second pocket, the first free end and the second free end positioned within the respective first pocket and second pocket avoid contamination of the respective vent tube member and the drinking straw.

* * * * *